US007731468B2

(12) United States Patent
Desjarlais et al.

(10) Patent No.: US 7,731,468 B2
(45) Date of Patent: Jun. 8, 2010

(54) BOOKBINDING COIL END CUTTING AND CRIMPING MACHINE

(75) Inventors: Matthew G. Desjarlais, Winnipeg (CA); Walter D. Klassen, Winnipeg (CA)

(73) Assignee: Gateway Bookbinding Systems Ltd., Winnipeg, Manitoba (CA)

( * ) Notice: Subject to any disclaimer, the term of this patent is extended or adjusted under 35 U.S.C. 154(b) by 881 days.

(21) Appl. No.: 11/549,301

(22) Filed: Oct. 13, 2006

(65) Prior Publication Data

US 2008/0089761 A1 Apr. 17, 2008

(51) Int. Cl.
*B42B 9/00* (2006.01)
*B42B 5/08* (2006.01)

(52) U.S. Cl. ..... 412/16; 412/39; 412/40

(58) Field of Classification Search ..... 140/121; 83/950; 412/6, 7, 16, 33, 34, 38–40
See application file for complete search history.

(56) References Cited

U.S. PATENT DOCUMENTS 4,387,583 A * 6/1983 Martin et al. ..... 72/20.2
5,695,308 A * 12/1997 Hastings et al. ..... 412/39
5,931,623 A * 8/1999 Hastings et al. ..... 412/39
6,000,897 A * 12/1999 DesJarlais ..... 412/40
6,056,495 A * 5/2000 Doyle et al. ..... 412/39
7,246,982 B2 * 7/2007 Desjarlais et al. ..... 412/40

OTHER PUBLICATIONS

Renz Operating Manual (14 pages).
Marlon Inc.—Operating Manual (15 pages).

* cited by examiner

*Primary Examiner*—Dana Ross
*Assistant Examiner*—Pradeep C Battula
(74) *Attorney, Agent, or Firm*—Adrian D. Battison; Ade & Company Inc.

(57) ABSTRACT

A machine for cutting and crimping the ends of a helical coil inserted into holes at an edge of a book to hold the coil in place is adjustable to accommodate different diameters of coil. A guide member for centering the axis of the coil in a centering direction is adjustable to accommodate different diameter coils and for adjusting the location of the axis in an adjustment direction at right angles to the centering direction depending upon the diameter of the coil. A cutting device has a blade movable in a slot of an anvil to shear on one side and to bend on the other side to form a crimped end portion. The adjustment of the axis causes the cutting device to cut the end portion longer for larger coils. The cutting device is adjustable to rotate the anvil relative to the axis to accommodate different helix angles.

11 Claims, 7 Drawing Sheets

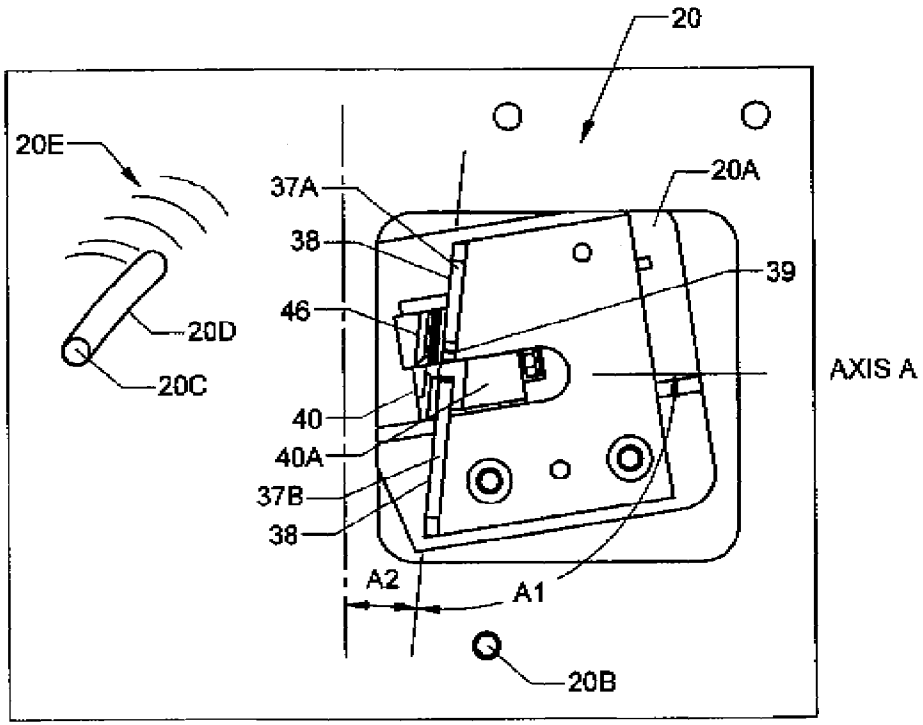
FIG. 5
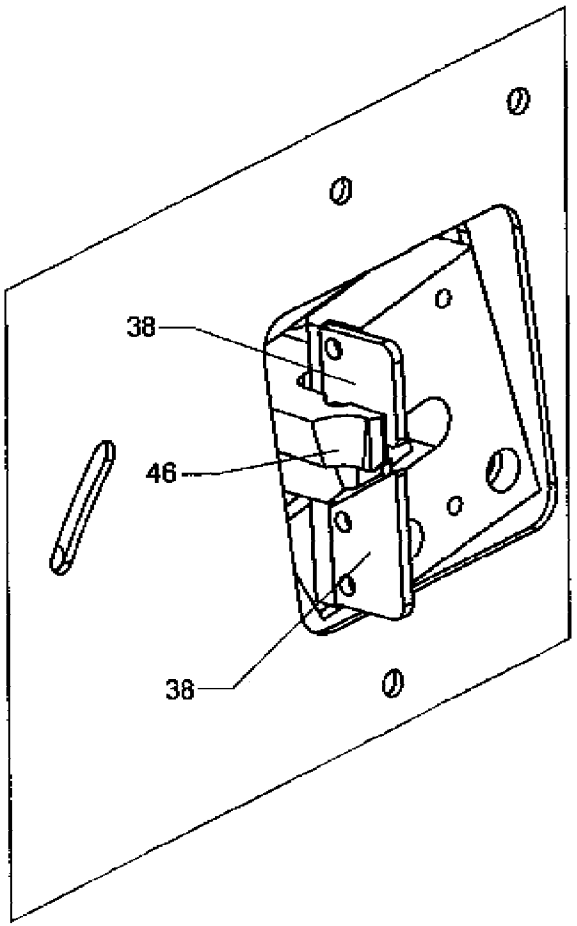

BOOKBINDING COIL END CUTTING AND CRIMPING MACHINE

This invention relates to the field of insertion of plastic coils into aligned holes at the edge of a collated book for binding the book, and particularly to a machine for cutting and crimping the ends of the coil after insertion into the edge of the book.

BACKGROUND OF THE INVENTION

In U.S. Pat. No. 6,000,897 of Desjarlais issued Dec. 14, 1999 is disclosed a machine for inserting a plastic coil into aligned holes at the edge of a book for binding of the book. Such coils are formed of a plastic filament which is wound into a helical coil. Coils of different diameters can be selected for different thicknesses of book with the diameters commonly available lying in the range 6 mm to 30( ) mm.

Also in U.S. patent application Ser. No. 10/449,713, filed Jun. 2, 2003 now issued as U.S. patent INSERT and corresponding Canadian application, filed May 27, 2003, Ser. No. 2,429,874 both entitled BOOKBINDING COIL INSERTION MACHINE is disclosed an improved arrangement for the same purpose.

Both of these patents provide an arrangement for inserting the coil into the book which includes end cutters for cutting and crimping the ends of the inserted coil so that the coil is cut to length and simultaneously the cut end is bent at an angle to the length of the filament forming the coil so that the coil is held in place in the end holes of the edge of the book. The machine disclosed is automated and is thus generally more suitable for longer production runs where the cost of the machine can be justified.

In other lower cost situations such as in smaller offices or in low production runs it is common to use either manual insertion of the coil or to use a roller or belt drive system to assist in coil insertion where the operator holds the book in place at the drive system till the frictional contact between the coil and the drive moves the coil to the required location. Such devices do not include a cutting and crimping device since the complexity is not suitable for the low cost drive system.

In order to effect the cutting and crimping action, therefore, the operator can use a manual cutting tool in the form of a pair of specially designed pliers. However these are awkward to use and sometimes ineffective if not properly located and operated relative to the coil and are disliked by the operators.

Previous devices have been provided for receiving the book and coil and for cutting and crimping the ends of the inserted coil. The operator holds the book in place and the device has a cutter device which is driven by suitable motive force such as pneumatics to effect the cutting action.

One machine of this type is manufactured by Renz of Heuback Germany which is known as "Coil Cut". This device is shown in an operating manual and comprises a pair of cutting devices at spaced positions across the machine for engaging the respective ends. Two V-shaped guides are located just inboard of the cutting devices such that the outside cylindrical surface of the coil is placed to sit in the V. These act to center the coil relative to the cutting device. Also, the height of the V-shaped guide relative to the cutting device is adjustable to accommodate different diameter of coil so as place the position of the filament to be cut in the knife at a required location. It will be appreciated that larger diameter coils require a longer crimped portion relative to smaller diameter coils to prevent the coil from being pulled through the first hole in the book and moving from its required position. This change in length of the crimping action can be obtained by moving the position of the filament relative to the knife so that the cutting action takes place at a different location on the cutting device. The cutting device is then shaped so that the different location on the cutting device causes the length of the crimped portion to be automatically cut to the require length.

The Renz machine is limited in coil size to the range 6 to 20 mm as clearly stated in the Manual. It cannot therefore operate with coils in the range 20 to 50 mm which are commonly available and thus suffers from this clear and severe restriction.

Also the guidance of the coils in the V-shaped guide is of limited effectiveness requiring careful attention by the operator to ensure that the coil is in the required location.

Another machine of this type which is currently available is that manufactured by Marion Inc of Boise Id. This is shown in an Operator's Manual and uses a similar arrangement to that described above. In this arrangement the side of the book is placed on a support plate the height of which is adjustable relative to the position of the cutting device so as to locate the position of the coil in the cutting device.

This machine is operable with coils of diameters 6 to 50 mm but only by purchasing and inserting three replacement cutting devices for different parts of the range. Thus there are three cutting devices where a first operates in the range 6 to 7 mm, a second in the range 8 to 25 mm and a third in the range 12 to 50 mm. These three devices are expensive and complex to replace and set up. Also the placement of the book against a plate does not itself accurately locate the coil leaving possibility for faulty crimping action due to the misplacement of the coil. Hold down devices are proposed to be added for the small size coil since misplacement is more problematic at the small diameters.

SUMMARY OF THE INVENTION

It is one object of the invention to provide a machine of the above general type which is improved to allow cutting of coils in the range 6 to 50 mm by adjustment of the machine without the necessity for replacement of parts.

According to a first aspect of the invention there is provided a machine for cutting and crimping at least one end of a helical coil formed from a filament coiled around a longitudinal axis of the coil so that an outer surface of the filament lies in a generally cylindrical surface, which coil is inserted into aligned holes at an edge of a collated book for binding the book, the machine being adjustable to receive a book carried by an operator and to accommodate different thickness of book and respective different diameter of coil as presented by the operator, the machine comprising:

a frame;

a guide member mounted on the frame for receiving and locating an outer peripheral surface of the coil so as to locate the axis of the coil relative to the frame the guide member being arranged to receive the coil adjacent an end of the coil;

a cutting device mounted on the frame adjacent the guide member for operating on the coil at the end of the coil;

the cutting device having an anvil portion, a blade portion and a clamp portion;

the anvil portion being arranged for lying between two turns of the coil with a side anvil surface facing one turn of the two turns;

the anvil portion having a cutting slot at the anvil surface;

the blade portion being movable relative to the anvil portion in a direction longitudinal of the coil axis so as to enter the slot through the anvil surface;

the anvil portion and the blade portion being arranged to provide a shearing action therebetween on one side of the blade portion and a bending action therebetween on an opposed side of the blade portion, such that said one turn of the filament is cut at said one side to form an end portion of the filament in the shearing action and such that the end portion of the filament is crimped to one side of said one turn at said opposed side in said bending action;

the clamp portion being configured to hold the filament securely while the blade portion shears and bends the filament;

the guide member being arranged to locate the center of the coil relative to the cutting device such that the blade portion contacts said one turn at a location thereon to cut the end at a first predetermined location and to bend the end at a second predetermined location;

the cutting device being mounted on the frame for adjustment movement relative thereto in a direction to change an angle of the anvil surface relative to a plane radial to the axis of the coil.

Preferably the cutting device is movable for said adjustment movement in a pivotal movement about an axis at right angles to a plane axial to the coil axis. The position of this axis is preferably spaced away from the cutting device itself but it can be located at any location provided the angle of the cutting device to the axis changes as it is moved Preferably the cutting device is carried on an adjustment member movable relative to the frame and there is provided a gauge having markings indicative of different diameters of coils for movement of the adjustment member to predetermined positions dependent on the diameter of the coil to be cut. In this way the operator can simply select the required angle by moving the gauge to the required position for the coil in hand.

Preferably the cutting device is movable to accommodate coils of diameter in the range 6 to 50 mm.

Preferably the guide member is adjustable so as to vary a location of the axis of the coil in an adjustment direction at right angles to the axis and wherein the cutting device is arranged to vary the length of the end portion of the filament as the location of the axis varies. The construction of the cutting device can be selected by a person skilled in the art to achieve this objective and many different arrangements of cutting device might be used.

Preferably the cutting slot and the blade portion are tapered in the adjustment direction such that a length between said shearing action on said one side of the blade portion and said bending action on said opposed side of the blade portion increases in said direction, so as to increase the length of the end portion of the filament.

Preferably, in addition, the cutting slot and the blade portion are shaped such that a width therebetween at said bending action on said opposed side of the blade portion changes in the adjustment direction, so as to change a diameter of the filament which can be received therebetween.

Preferably the guide member is arranged to be adjustable to receive and locate different diameter of coils and to locate the axes of the different diameters at a centered common location in a centering direction at right angles to said adjustment direction and at right angles to the axes, and adjustment of the guide member to accommodate the different diameter of coils acts to cause relative movement between the coils and the cutting device in said adjustment direction such that coils of larger diameter have an end portion of a longer length than coils of a smaller diameter.

Preferably the guide member comprises two side guide walls and a base wall, thus locating the coil effectively at three points of contact. Preferably the side guide walls are spaced in said centering direction and arranged to engage the periphery of the coil on either side of the axis to locate said axis in the centering direction, with the side guide walls being adjustable so as to change the spacing therebetween for different diameter coils. Preferably the base wall is arranged to define a point of contact engaging the periphery of the coil at a position between the side guide walls, and the point of contact of the base wall is arranged to move in said adjustment direction in response to movement of said side guide walls in said centering direction. Thus the adjustment is achieved automatically by the operator moving the side guides to the required spacing for the required coil.

In one manner of achieving this movement of the point of contact, the base wall includes an inclined portion inclined toward one of the side guide walls such that the point of contact for different coils moves along the inclined portion as the distance of the axis of the coil from said one of the side guide walls increases as the diameter of the coil increases. In an alternative arrangement, the point of contact with each coil may be the same and the base wall carrying that point of contact is moved in the adjustment direction.

Preferably there is provided a pusher member on the frame movable by the operator for engaging the coil and pushing the coil into the cutting device.

According to a second aspect of the invention there is provided a machine for cutting and crimping at least one end of a helical coil formed from a filament coiled around a longitudinal axis of the coil so that an outer surface of the filament lies in a generally cylindrical surface, which coil is inserted into aligned holes at an edge of a collated book for binding the book, the machine being adjustable to receive a book carried by an operator and to accommodate different thickness of book and respective different diameter of coil as presented by the operator, the machine comprising:

a frame;

a guide member mounted on the frame for receiving and locating an outer peripheral surface of the coil so as to locate the axis of the coil relative to the frame, the guide member being arranged to receive the coil adjacent an end of the coil;

a cutting device mounted on the frame adjacent the guide member for operating on the coil at the end of the coil;

the cutting device being arranged to provide a shearing action at one position on the filament and a bending action at another spaced position on the filament such that said one turn of the filament is cut at said one position to form an end portion of the filament in the shearing action and such that the end portion of the filament is crimped to one side of said one turn at spaced position in said bending action;

wherein the guide member is adjustable so as to vary a location of the axis of the coil in an adjustment direction at right angles to the axis;

wherein the cutting device is arranged to vary the length of the end portion of the filament as the location of the axis varies;

wherein the guide member is arranged to be adjustable to receive and locate different diameter of coils and to locate the axes of the different diameters at a centered common location in a centering direction at right angles to said adjustment direction and at right angles to the axes;

and wherein adjustment of the guide member to accommodate the different diameter of coils acts to cause relative movement between the coils and the cutting device in said adjustment direction such that coils of larger diameter have an end portion of a longer length than coils of a smaller diameter.

BRIEF DESCRIPTION OF THE DRAWINGS

One embodiment of the invention will now be described in conjunction with the accompanying drawings in which:

FIG. 5 is an isometric view of the cutting device of FIGS. 1 and 2 with the coil omitted.

In the drawings like characters of reference indicate corresponding parts in the different figures.

DETAILED DESCRIPTION

Figure 1:
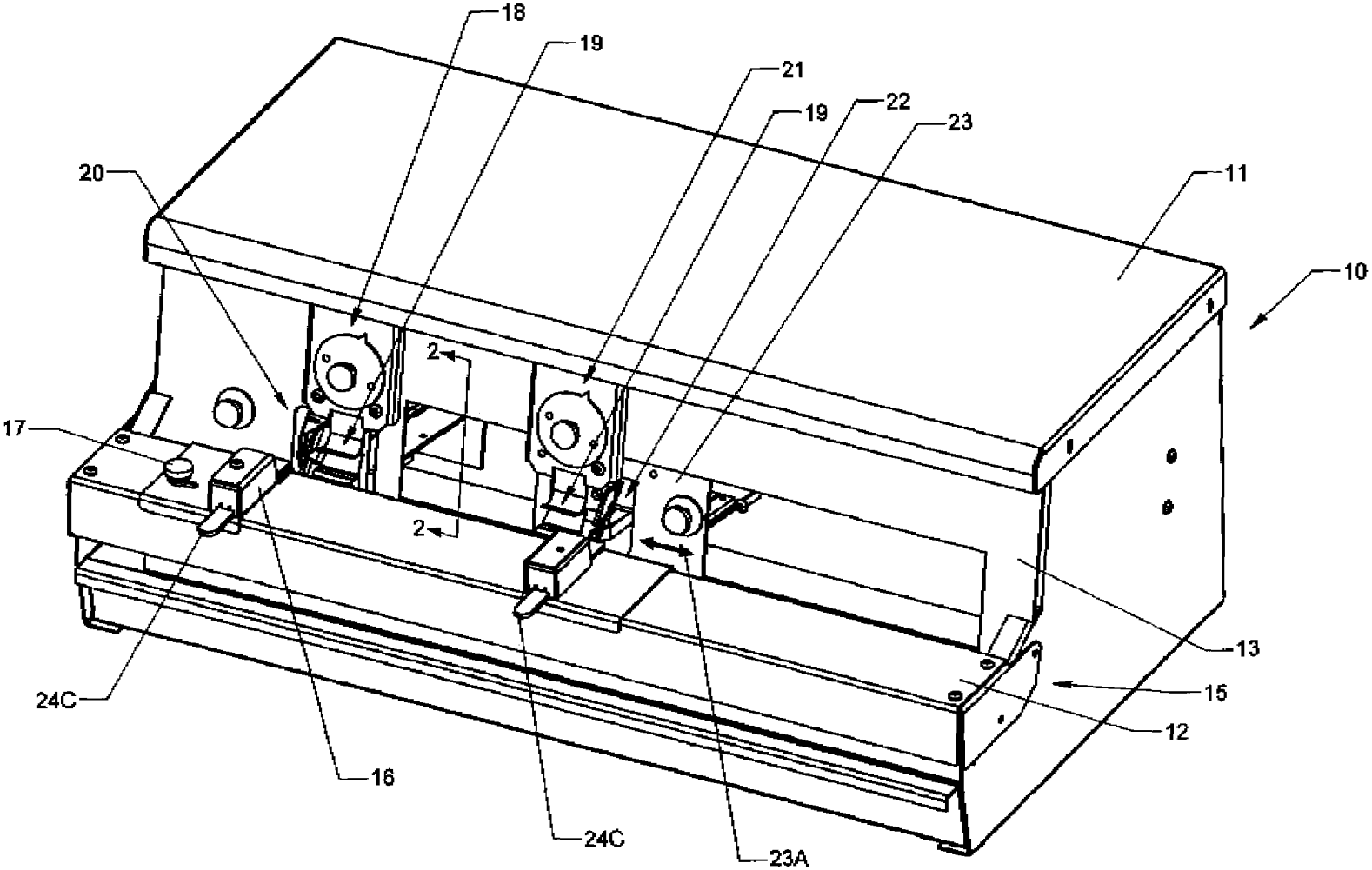
FIG. 1 is an isometric view of a machine according to the present invention.

The machine for cutting and crimping the end of a coil of a bound book is indicated in FIG. 1 generally at 10.

Such bound books are conventionally well known where a collated stack of pages to form the book has holes cut along one edge of the book with the holes in a row along the edge and the holes of each page stacked so that the coil can pass through all of the pages. Thus it is well known that such a coil can be inserted by inserting the end of the coil in a first of the holes and by rolling the helical coil around its axis so as to feed it along the edge of the book with the end passing through each hole in turn until the coil is inserted all of the holes and two ends of the coil stand proud of the ends of the book.

It is well known that such coils can vary in diameter from a smallest coil which is conventionally used of the order of 6 mm in diameter to a largest coil which is conventionally used which is 50 mm in diameter. Such coils have a different helix angle so that the angle of the filament to the radial plane of a 6 mm coil is larger than the angle of the filament to the radial plane of a 50 mm coil. This angle of course varies as the pitch of the helix varies. It is also commonly known that the coils are formed of filament which is of a higher gauge or thickness for the larger coils than the filament that is used for the smaller coils.

In the arrangement of the present invention the intention is to provide a device which receives the bound book where the ends of the coil project beyond the ends of the book after initial insertion and then is activated to cut and crimp the ends of the coil. Thus the ends of the coil must firstly be cut to a required length so that the amount of coil projecting beyond the end of the book is reduced and secondly an end most portion of the filament must be crimped at an angle to its length so as to hold the coil against rotation around its axis relative to the book which will cause the coil to come unbound. Generally an end portion of the filament is crimped so as to lie generally parallel to the axis of the coil and this portion buffs against the edges of the first hole to prevent the coil from turning relative to the book. It is also known that the length of the crimped portion should be longer for larger diameter coils than it is for smaller diameter coils.

Existing machines are available to assist the operator in inserting the coil into the edge of the book. The present machine is proposed for use with coil insertion machines which do not utilize an integrated cutting and crimping system. Simple machines for inserting the coil are widely available for use in facilities where lower production numbers are required. Such machines are commonly easy to set up and may in many cases simply comprise a pair of rollers so that the operator presses the coil against the roller so that the rollers rotate the coil around its axis in the threading action.

The machine shown in FIG. 1 comprises a base frame structure 11 which supports a shelf 12 mounted on a front surface 13. The height of the shelf 12 relative to the front surface 13 can be adjusted upwardly and downwardly by sliding along a guide system 15. The height of the shelf can be adjusted to accommodate different thicknesses of books since the intention is that the bottom page of the book will be laid on the shelf to present the book forwardly to the operating elements at the front surface 13.

On the shelf 12 is provided an end stop 16 which itself is adjustable transversely along the shelf by adjustment screw 17 manually operable to locate the end stop 16 at the required position. Thus the end stop 16 provides an upstanding shoulder which butts the end of the book. Thus the book is located both in vertical and in side to side position by the adjustable elements 12 and 16.

On the frame 11 is mounted a first guide member 18 which includes jaws 19 arranged to engage and locate the coil at the spine of the book sitting on the shelf 12. The guide member 18 is located adjacent the cutting device 20 which is mounted on the frame 11. A second guide member 21 is located adjacent a second cutting device 22 both of which are carried on a sub-frame portion 23 slidable horizontally as indicated at 23A relative to the frame 11 at the front surface 13. Thus the second guide member and second cutting device can be moved towards and away from the first guide member in order to accommodate different lengths of the coil at the edge of the book. Thus one side edge of the book is located at the end stop 16 and the other side edge of the book is positioned at a position on the shelf 12 depending upon the length of the book following which the cutting device is adjusted to the following position relative to the side edge of the book. In this way the cutting devices can be positioned just beyond the ends of the book at the exposed portions of the coil to provide the cutting and crimping action required and described above. The guide member jaws 19 locate and position the coil at the edge of the book so as to ensure that the coil is properly located in the cutting devices 20 and 22. Also on the shelf and integrated into the end stop assemblies 16 is provided two pushing fingers 24C each located in front of a respective one of the cutting devices so that the operator can use the pushing devices manually to move a pushing finger forwardly from the pushing device into engagement with the coil at the cutting device to ensure that the coil is properly seated in the cutting device and to resist any tendency of the coil to curve out away from the cutting device. The pushing member thus allows the operator to provide a pushing action without the necessity of using a finger of the operator which could become caught or pinched in the cutting device.

Figure 2:
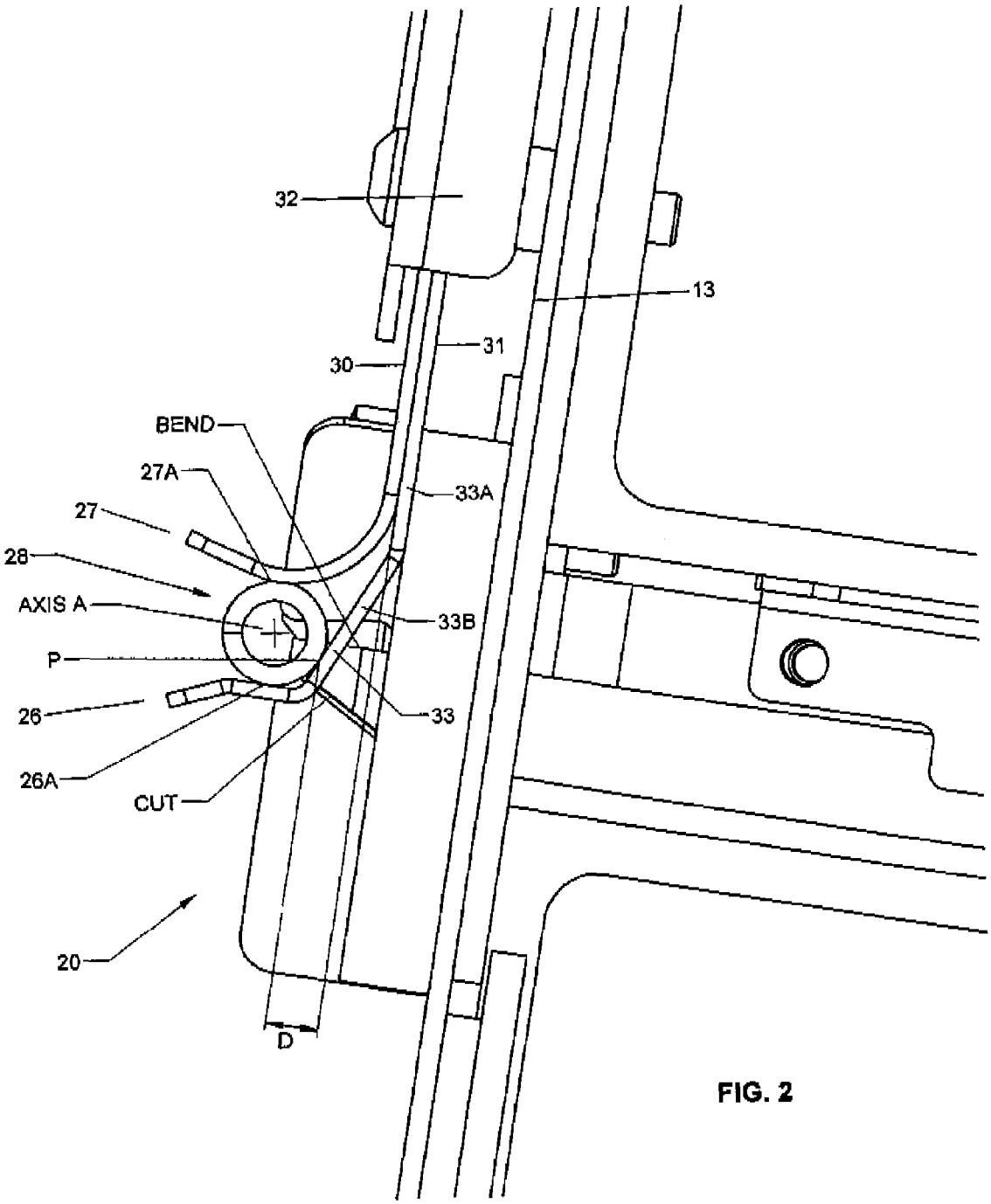
FIG. 2 is a cross-sectional view along the lines 2-2 of FIG. 1 showing the relationship of the guide member and the cutting device in relation to a coil of a smaller diameter.
Figure 4:
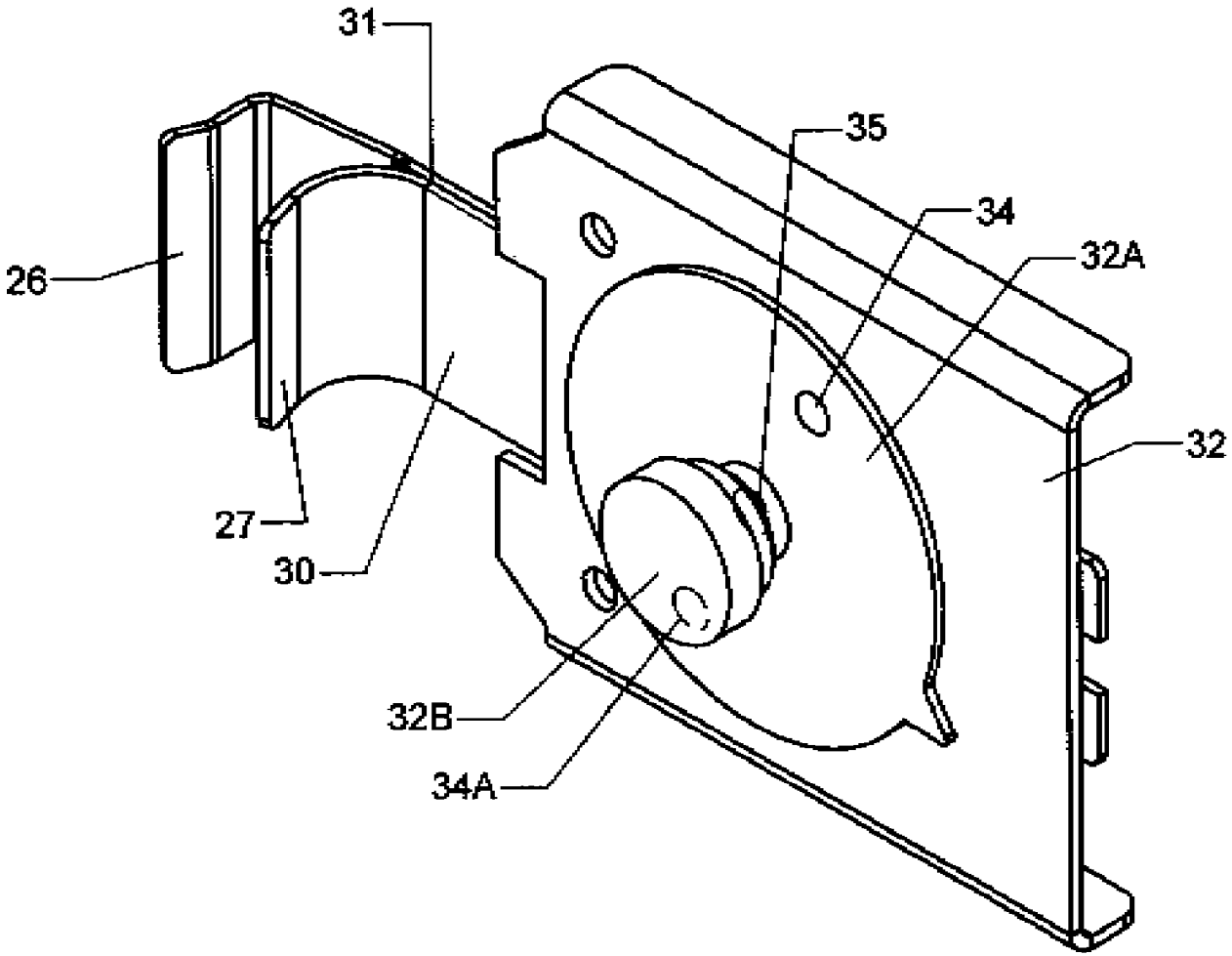
FIG. 4 is an isometric view of the guide member of FIGS. 1 and 2.

Turning now to FIGS. 2 and 4, the guide member is shown in more detail. It will be appreciated that the guide members 18 and 21 are substantially identical so that only one of these will be described in detail.

Figure 3:
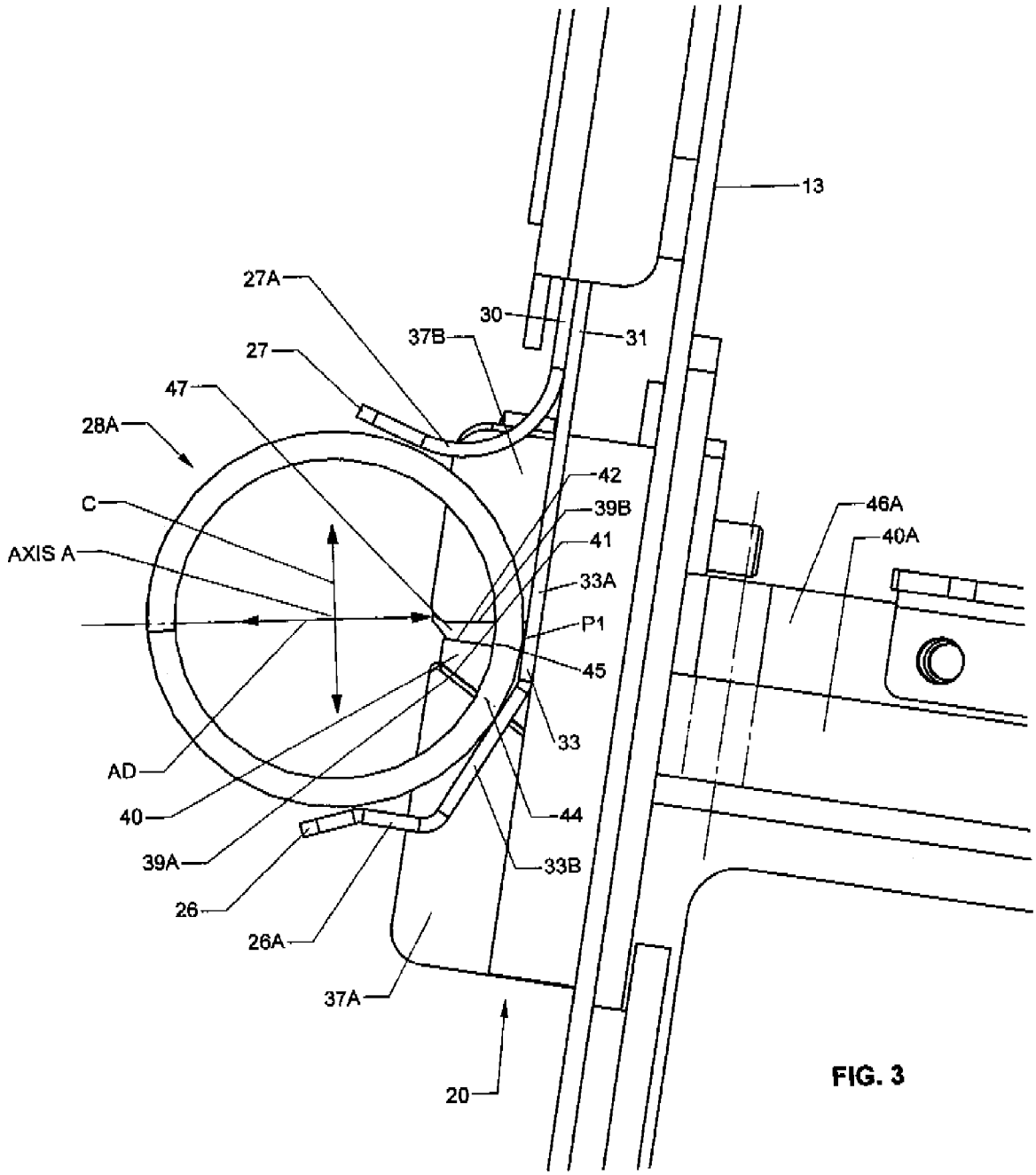
FIG. 3 is a cross-sectional view along the lines 2-2 of FIG. 1 showing the relationship of the guide member and the cutting device in relation to a coil of a larger diameter.

The guide member comprises a pair of clamping plates 26 and 27 which act to squeeze the coil 28 between the plates. The plates are shaped so as to stand forwardly from the front surface 13 of the frame 11. The plates are attached to support plate portions 30 and 31 which are carried in a housing 32. The housing 32 receives a manually rotatable adjustment member 32A which can be moved by the operator. The adjustment member 32A attaches to the plate portions 30 and 31 by pins 34 and 34A which project through holes in the rotatable adjustment member 32A into the plate members 30 and 31. In this way rotation of the adjustment member 32A around a centre support pin 35 drives one of the plates 30 and 31 in one direction and the other of the plates 30 and 31 in the opposite direction. Thus it will be appreciated that rotation of the adjustment member 32A opens and closes the gap between the clamping plates 26 and 27 to squeeze those plates against the sides of the coil 28. In FIG. 2 the clamping plates are shown cooperating with a relatively small coil 28. In FIG. 3 the clamping plates 26 and 27 are shown cooperating with a relatively large coil 28A.

As will be seen by comparing FIGS. 2 and 3, the clamping plates 26 and 27 are shaped to define an area 26A and 27A of closest approach which are located so that they contact the smallest size coils in the range 6 to 12 mm approximately at diametrically opposed positions on those coils. Thus the operator can adjust the member 32A to move the clamping plates 26 and 27 to a position touching the outside periphery of the coil thus gauging the diameter of the coil and positioning the plate members at required position to receive the coil when pushed between the plate members from the side opposite the surface 13.

The larger coil 28A shown in FIG. 3 contacts the coil guide at a position which is offset from a diameter. However, as the larger size coils have much more tolerance to slight inaccuracies in their positioning, the fact that the coil is contacted butted partway around its periphery from its diameter still acts to locate the coil between the two plate members.

The guide member further includes a base wall 33. Thus the coil when inserted into the guide member is contact at 3 contact points around its periphery. The clamping plates 26 and 27 acts as side guide walls locating the axis A of the coil in a centering direction extending between the clamping members as indicated at direction C.

As adjustment of the clamping members occurs simultaneously so that one of the clamping members moves in one direction while the other clamping member moves in the opposite direction, the axis A of the coil lies at the same centered position within the direction C regardless of the diameter of the coil. This locates the coil relative to the cutting device 20 at the same position relative to the cutting device in the centering direction C regardless of the diameter of the coil.

The base wall 33 provides the third point of contact with the coil so that the coil is always pushed between the clamping plates 26 and 27 so that it then butts against the base wall 33. Thus each coil regardless of its diameter is moved into its proper position between the clamping plates to provide the proper centering action.

The base wall 33 is attached to the clamping plate 26 and forms an integral element therewith connecting to the plate portion 31 which slides along the direction of the surface 13. The base wall 33 includes a flat portion 33A and an inclined portion 33B which extends at an inclined angle away from the end of the flat portion 33A toward a base 26A of the clamping plate 26. The base wall thus provides a point of contact with the periphery of the coil which moves depending upon the diameter of the coil. With the small diameter coil shown in FIG. 2, the point of contact indicated at P is located closely adjacent the base 26A and thus is spaced from the flat portion 33A by a distance D. The larger coil shown in FIG. 3 contacts the base wall at a contact point P1 which lies on the flat portion 33A. Coils of an intermediate diameter between the larger size shown in FIG. 3 and the smaller size shown in FIG. 2 will provide a point of contact which is located at a position along the length of the inclined portion 33B which depends upon the diameter of the coil so that the distance D for such coils decreases.

Thus it will be noted that in the small coil of FIG. 2 that the periphery of the coil is supported at a position spaced by the distance D from the plate 33A. The periphery of the coil in the position of FIG. 3 however butts the flat portion 33A and thus has moved closer to the portion 33A. In other words the base wall locates that portion of the periphery of each coil at a required position relative to the flat portion 33A in dependence upon the diameter of the coil.

This shaping of the base wall 33 and its cooperating with the clamping plate 26 is one way to achieve this movement of the peripheral portion of the coil. Other mechanical arrangements can be provided which define a base wall member which literally moves in the direction AD. This direction AD thus provides an adjustment direction which moves the periphery of the coil along that direction depending upon the diameter of the coil.

Figure 7:
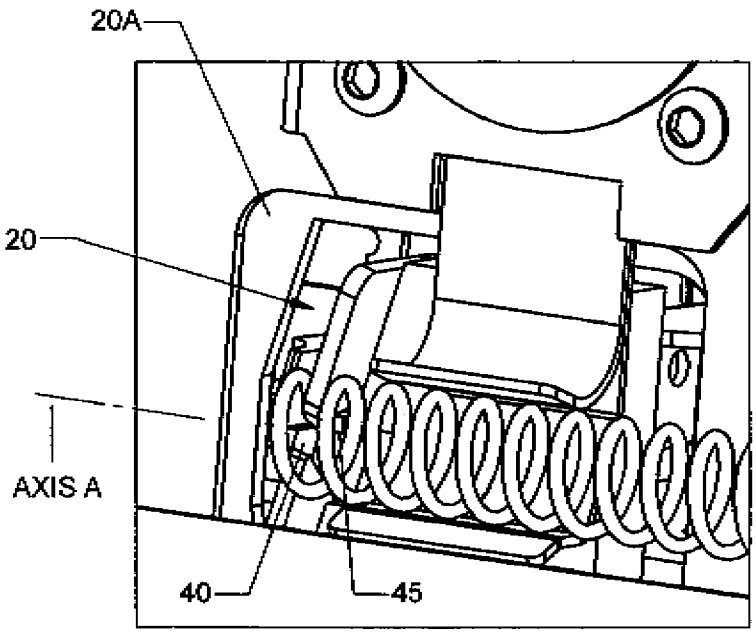
FIG. 7 is an isometric view of the cutting device of FIGS. 1 and 2 with the coil cut and the end crimped.
Figure 6:
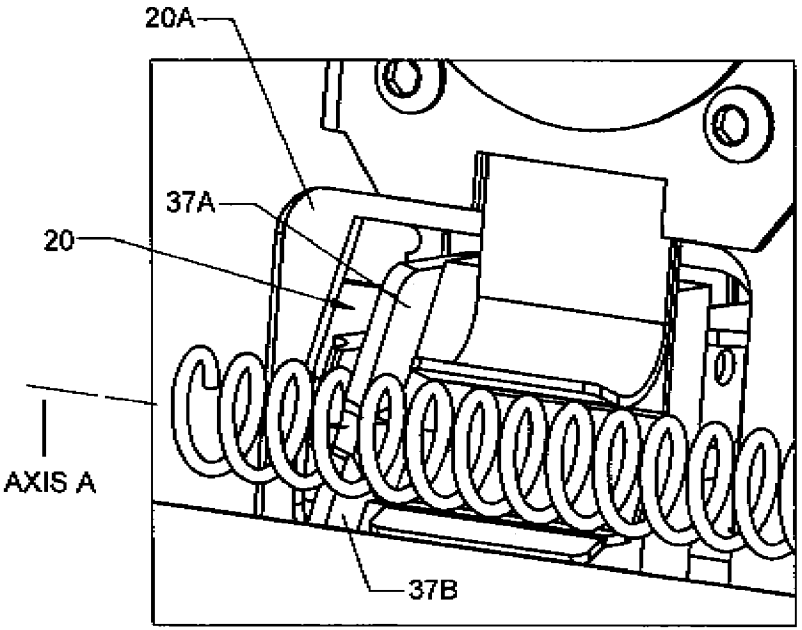
FIG. 6 is an isometric view of the cutting device of FIGS. 1 and 2 with the coil in place ready to be cut.

Turning now to FIGS. 3, 5, 6 and 7, further details of the cutting device are provided. The cutting device comprises anvil members 37A and 37B having an anvil surface 38 and a slot 39 in the anvil surface. The anvil member cooperates with a blade member 40 which is driven by an actuator mechanism 40A so as to move along the axis of the coil as shown in FIGS. 6 and 7. A clamp device 46, by use of a spring attached to lever 46A, exerts a holding force on the filament to secure it against the anvil surface 38.

As best shown in FIG. 3, the blade member 40 has a first side edge 41 and a second side edge 42. These side edges cooperate with sides of the slot bounded by edges 39A and 39B in the anvil members 37A and 37B. The side edge 41 of the blade acts in a shearing action with a cooperating shear surface at the edge of the slot at 39A which is the lower side as shown in FIGS. 3 and 5. This shearing edge 41 therefore acts to cut the filament along a cut line 44 as shown in FIG. 3. At the opposite side 42 of the blade 40 is provided a bending action so that no cutting occurs on the second side 42. Instead an end portion 45 of the filament is bent at the side 42 of the blade so that the movement of the blade along a line closely parallel to the axis A acts to bend the end portion 45 along a direction parallel to the axis A. This shearing and bending action is known to persons skilled in the art to provide the cut end portion that is crimped in the required direction.

As best shown in FIG. 3 the side 42 is generally along a radius of the axis A whereas the side 41 is arranged at an angle to the side 42 so that the space between those sides increases as the distance towards the flat portion 33A decreases.

As previously explained smaller coils are located by the guide member so that the periphery thereof is supported away from the flat plate 33A. Larger coils are supported by the guide member so that the periphery is located at the plate 33A. This adjustment of the periphery of the coil depending upon the diameter of the coil positions the periphery of the coil shallower or deeper within the cut and bend slot. The positioning of the coils shallower or deeper within the slot thus acts to cause the periphery to engage a different portion of the blade member which is narrower for smaller coils and wider for larger coils.

Looking therefore at FIG. 2, the small coil cooperates with the blade at the narrowest part of the blade so that the end portion which is sheared and then bent is much smaller in length than is the end portion of the coil in FIG. 3.

Looking at FIG. 3, In order to provide a bending action on the side 42 of the blade at the anvil, there is a space 47 between the side 42 and the side of the slot bounded by edge 39B within which the filament lies as it is bent without shearing of the filament occurring. It will be noted that the space 47 also increases in width so that it is narrowest for the smallest coils spaced from the plate 33A and widest for the larger coils at the plate 33A. This increase in width of the space 47 thus accommodates the increase in thickness or gauge of the filament which is used in the larger coils.

In this way the guide member and the cutting device are located so that the guide member properly positions the coil, regardless of the diameter of the coil selected, at the proper position for the shearing action to occur and for the bending action to occur. Thus the axis of the coil is held at a centered position along the direction C. The adjustment by the operator of the spacing between the clamping plates 26 and 27 also automatically adjusts the depth that the coil is inserted into the guide member by moving the contact point. This movement of the contact point allows the periphery of the coil to move shallower or deeper into the cut and bend slot so as to cooperate with the required position of the blade to accord with the selected diameter of the coil.

It will be appreciated that the adjustment of the coil guide device is effected at the beginning of a production run by the operator selecting one of the coils to be cut which is then inserted between the clamping plates and the adjustment member 32A operated. A clamping knob 32B is operated so as to clamp the adjustment member 32A at the required adjusted position.

In addition to the above adjustments, as best shown in FIGS. 5, 6 and 7 the whole of the cutting device 20 including the blade and the anvil is mounted on a housing 20A which is carried for pivotal movement about a mounting pin 20B. A clamping adjustment 20C movable within a slot 20D can be actuated to select the required position of the housing 20A about the pin 20B. This adjustment movement causes a change in the angle A1 of the surface 38 of the anvil relative to the axis of the coil as indicated at axis A. This adjustment thus changes the angle A2 of this surface 38 relative to a radial plane of the axis A. The adjustment is effected by the operator releasing the clamp 20C and moving the clamp along the slot 20D to a required position. A gauge 20E provides a series of positions marked with the diameter of the coil to be used so that the operator can place the housing at a required position by selecting the diameter on the gauge 20E. This selected position moves the surface 38 of the anvil to a required angle A2 relative to the radial plane. This adjustment can be effected so as to accommodate the changes in helix angle of the coils from the smallest coils to the largest coils. It will be appreciated that this helix angle changes in view of the change of diameter necessary for the coil to cooperate with the holes in the book. The mounting therefore of the cutting device on a housing which is pivotally mounted relative to the frame of the machine allows the anvil surface of the cutting device to be moved relative to the guide member and thus relative to the axis of the coil which is determined by the guide member.

Figure 8:
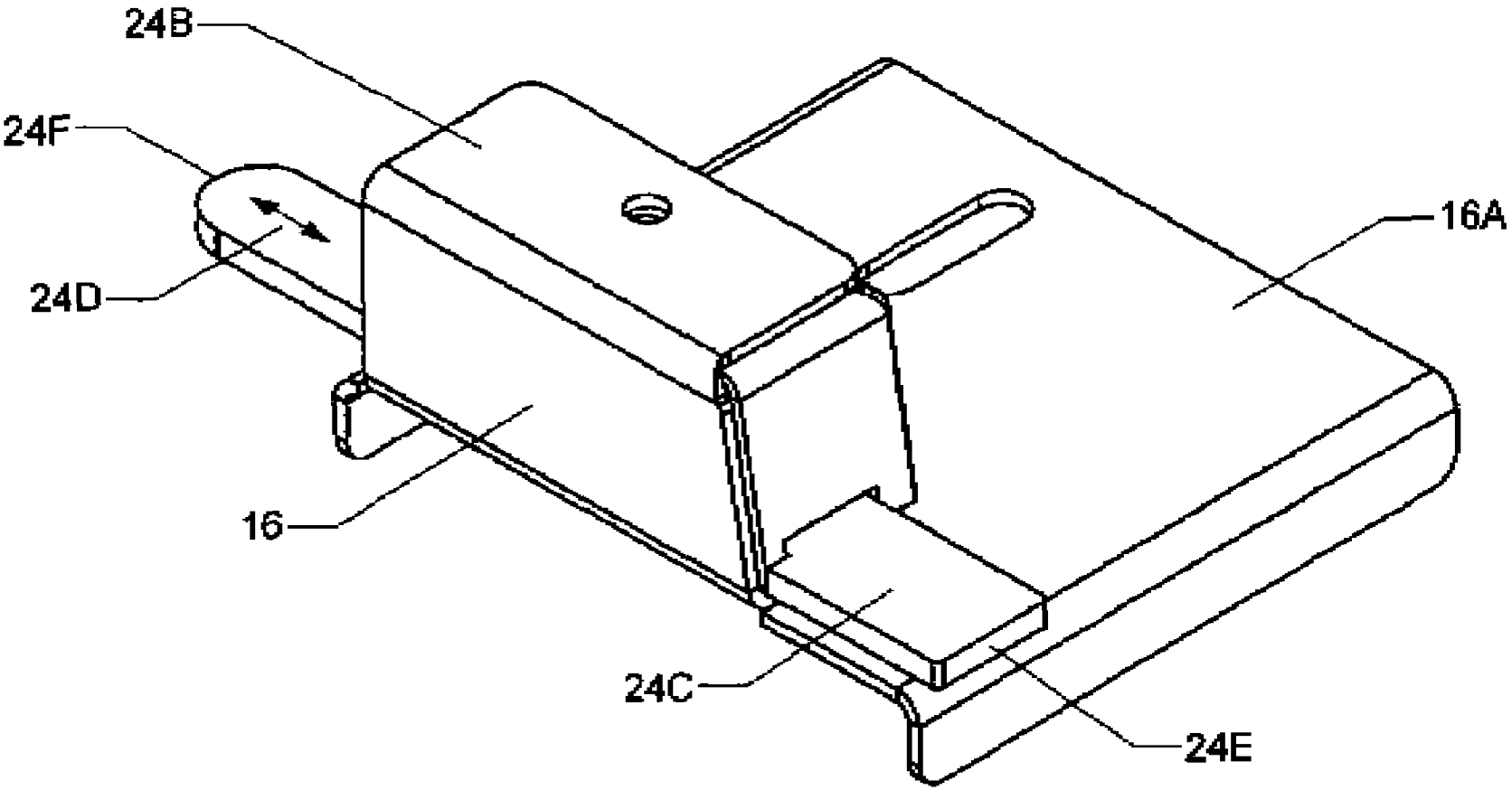
FIG. 8 is an isometric view of the end stop and pusher member of FIG. 1.

The pushing device 24C shown in FIG. 8 comprises a base plate 16A which is mounted on the shelf 12 together with an upstanding housing 24B which contains a finger 24C which can slide across the plate 16A forwardly and rearwardly as indicated by the arrow 24D. The finger provides a forward most projection 24E for engaging the coil at a position aligned with the anvil member. A tail end 24F of the finger member 24C can be pushed by the operator so as to engage the coil at a position thereon opposite the contact point P so as to push the coil against the base member to ensure proper contact against the base member and proper positioning of the coil within the slot of the cutting device. The end stop 16 provides an upstanding shoulder which butts the left side end of the book thus locating the book in the required location for the cut and bend operation.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A machine for cutting and crimping at least one end of a helical coil formed from a filament coiled around a longitudinal axis of the coil so that an outer surface of the filament lies in a generally cylindrical surface, which coil is inserted into aligned holes at an edge of a collated book for binding the book, the machine being adjustable to receive a book carried by an operator and to accommodate different thickness of book and respective different diameter of coil as presented by the operator, the machine comprising:

a frame;

a guide member mounted on the frame for receiving and locating an outer peripheral surface of the coil so as to locate the axis of the coil relative to the frame, the guide member being arranged to receive the coil adjacent an end of the coil;

a cutting device mounted on the frame adjacent the guide member for operating on the coil at the end of the coil;

the cutting device having an anvil portion, a blade portion and a clamp portion;

the anvil portion being arranged for lying between two turns of the coil with a side anvil surface facing one turn of the two turns;

the anvil portion having a cutting slot at the anvil surface;

the blade portion being movable relative to the anvil portion in a direction longitudinal of the coil axis so as to enter the slot through the anvil surface;

the anvil portion and the blade portion being arranged to provide a shearing action therebetween on one side of the blade portion and a bending action therebetween on an opposed side of the blade portion, such that said one turn of the filament is cut at said one side to form an end portion of the filament in the shearing action and such that the end portion of the filament is crimped to one side of said one turn at said opposed side in said bending action;

the clamp portion being configured to hold the filament while the blade portion shears and bends the filament;

the guide member being arranged to locate the center of the coil relative to the cutting device such that the blade portion contacts said one turn at a location thereon to cut the end at a first predetermined location and to bend the end at a second predetermined location;

the cutting device being mounted on the frame for adjustment movement relative thereto in a direction to change an angle of the anvil surface relative to a plane radial to the axis of the coil.

2. The machine according to claim 1 wherein the cutting device is movable for said adjustment movement in a pivotal movement about an axis at right angles to a plane axial to the coil axis.

3. The machine according to claim 1 wherein the cutting device is carried on an adjustment member movable relative to the frame and wherein there is provided a gauge having markings indicative of different diameters of coils for movement of the adjustment member to predetermined positions dependent on the diameter of the coil to be cut.

4. The machine according to claim 1 wherein the cutting device is movable to accommodate coils of diameter in the range 6 to 50 mm.

5. The machine according to claim 1 wherein the guide member is adjustable so as to vary a location of the axis of the coil in an adjustment direction at right angles to the axis and wherein the cutting device is arranged to vary the length of the end portion of the filament as the location of the axis varies.

6. The machine according to claim 5 wherein the cutting slot and the blade portion are tapered in the adjustment direction such that a length between said shearing action on said one side of the blade portion and said bending action on said opposed side of the blade portion increases in said direction, so as to increase the length of the end portion of the filament.

7. The machine according to claim 5 wherein the cutting slot and the blade portion are shaped such that a width therebetween at said bending action on said opposed side of the blade portion changes in the adjustment direction, so as to change a diameter of the filament which can be received therebetween.

8. The machine according to claim 5 wherein the guide member is arranged to be adjustable to receive and locate different diameter of coils and to locate the axes of the different diameters at a centered common location in a centering direction at right angles to said adjustment direction and at right angles to the axes, and wherein adjustment of the guide member to accommodate the different diameter of coils acts to cause relative movement between the coils and the cutting device in said adjustment direction such that coils of larger diameter have an end portion of a longer length than coils of a smaller diameter.

9. The machine according to claim 8 wherein the guide member comprises two side guide walls and a base wall, the side guide walls being spaced in said centering direction and arranged to engage the periphery of the coil on either side of the axis to locate said axis in the centering direction, the side guide walls being adjustable so as to change the spacing therebetween for different diameter coils, the base wall being arranged to define a point of contact engaging the periphery of the coil at a position between the side guide walls, and wherein the point of contact of the base wall is arranged to move in said adjustment direction in response to movement of said side guide walls in said centering direction.

10. The machine according to claim 9 the base wall includes an inclined portion inclined toward one of the side guide walls such that the point of contact for different coils moves along the inclined portion as the distance of the axis of the coil from said one of the side guide walls increases as the diameter of the coil increases.

11. The machine according to claim 1 wherein there is provided a pusher member on the frame movable by the operator for engaging the coil and pushing the coil into the cutting device.

* * * * *